US008584652B2

(12) United States Patent
Netsu et al.

(10) Patent No.: US 8,584,652 B2
(45) Date of Patent: Nov. 19, 2013

(54) CYLINDER HEAD FOR INTERNAL COMBUSTION ENGINE

(75) Inventors: Hironao Netsu, Yokohama (JP); Takuya Taniguchi, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 526 days.

(21) Appl. No.: 12/995,045

(22) PCT Filed: Apr. 22, 2009

(86) PCT No.: PCT/JP2009/058020

§ 371 (c)(1),
(2), (4) Date: Nov. 29, 2010

(87) PCT Pub. No.: WO2009/147910

PCT Pub. Date: Dec. 10, 2009

(65) Prior Publication Data

US 2011/0083623 A1 Apr. 14, 2011

(30) Foreign Application Priority Data

Jun. 5, 2008 (JP) ..... 2008-147529

(51) Int. Cl.
*F02M 61/14* (2006.01)
*F02B 75/32* (2006.01)

(52) U.S. Cl.
USPC ..... 123/470; 123/197.5

(58) Field of Classification Search
USPC ..... 123/197.5, 470, 41.82 R; 164/132, 137; 29/888.06
See application file for complete search history.

(56) References Cited

U.S. PATENT DOCUMENTS

| | | | | | |
|---|---|---|---|---|---|
| 4,206,725 | A * | 6/1980 | Jenkel et al. | 123/470 |
| 5,566,658 | A * | 10/1996 | Edwards et al. | 123/470 |
| 5,899,190 | A * | 5/1999 | Nakagomi et al. | 123/470 |
| 6,269,798 | B1 * | 8/2001 | Takahashi et al. | 123/470 |
| 6,431,152 | B1 * | 8/2002 | Estacio | 123/470 |
| 6,799,540 | B2 * | 10/2004 | Akiwa et al. | 123/41.82 R |
| 7,334,572 | B1 * | 2/2008 | Diggs et al. | 123/470 |
| 7,980,206 | B2 * | 7/2011 | Nagafuchi | 123/41.82 R |

FOREIGN PATENT DOCUMENTS

| | | | |
|---|---|---|---|
| JP | 11-82242 | A | 3/1999 |
| JP | 2003-269244 | A | 9/2003 |
| JP | 2005-180277 | A | 7/2005 |

* cited by examiner

*Primary Examiner* — Thomas Moulis
(74) *Attorney, Agent, or Firm* — Foley & Lardner LLP

(57) ABSTRACT

Fuel injection valves 3 each inserted into injection valve mounting holes 2 are fixed to cylinder head 1 through bifurcated clamps 21. Clamps 21 each include base portion 22 brought into abut contact with and supported on middle bolt 14*a* which is disposed at the middle portion of cam bracket 13, bifurcated tip end portion 23 pressing fuel injection valve 3, and intermediate portion 24 fastened by bolt 25 having a tip end portion which is screwed into cylinder head 1. Four clamps 21 are arranged on a straight line along a direction of a row of cylinders. Respective clamps 21 corresponding to cylinders #1 and #2 and respective clamps 21 corresponding to cylinders #3 and #4 are arranged symmetrically with each other such that base portions 22 are disposed on an outside. Core supporting hole 31 is disposed at a central portion of cylinder head 1 which is free from coverage by clamp 21. With this construction, it is possible to effectively release gas.

8 Claims, 2 Drawing Sheets

CYLINDER HEAD FOR INTERNAL COMBUSTION ENGINE

TECHNICAL FIELD

The present invention relates to a cylinder head for a multi-cylinder internal combustion engine in which a water jacket is formed by casting, and more particularly to an improved cylinder head for an internal combustion engine in which fuel injection valves each inserted into an injection valve mounting hole at a substantially central portion of a combustion chamber are fixed by means of bifurcated clamps, respectively.

BACKGROUND ART

It is known that in an in-cylinder direct injection internal combustion engine, for instance, such as a diesel engine, fuel injection valves are inserted into injection valve mounting holes extending through a substantially central portion of a combustion chamber, and fixed to the engine by using bifurcated clamps, respectively.

Patent Literature 1 discloses a cylinder head for an in-line four-cylinder internal combustion engine of such a type. An intake camshaft and an exhaust camshaft are disposed on opposite sides of four fuel injection valves arranged in an in-line manner. Four clamps are arranged in line along a direction of the row of the engine cylinders. Each of the clamps includes a base portion, a bifurcated tip end portion and an intermediate portion therebetween. The base portion is brought into abut contact with and supported on a fulcrum portion formed by a pin which is projectingly fitted to the cylinder head. The bifurcated tip end portion presses the fuel injection valve. The intermediate portion is fastened by a bolt having a tip end portion which is screwed into the cylinder head. The clamp is upwardly and downwardly swingable about the fulcrum portion as a fulcrum. The fuel injection valve is stiffly fixed to the cylinder head by fastening the intermediate portion of the clamp by means of the bolt.

CITATION LIST

Patent Literatures

Patent Literature 1: Japanese Patent Application Unexamined Publication No. 2003-269244

SUMMARY OF INVENTION

Problems to be Solved by Invention

In the above-described construction of the conventional art, the clamps corresponding to cylinder #1 and cylinder #2 are arranged in such an attitude that the bifurcated tip end portions are directed toward a front side of the engine and the clamps corresponding to cylinder #3 and cylinder #4 are arranged in such an attitude that the bifurcated tip end portions are directed toward a rear side of the engine. That is, in the four clamps, two thereof are arranged symmetrically with the other two. The pin serving as the fulcrum portion for the clamp corresponding to the cylinder #2 and the pin serving as the fulcrum portion for the clamp corresponding to the cylinder #3 are arranged adjacent to each other at a central portion of the cylinder head in the direction of the row of the cylinders.

Accordingly, it is not possible to provide core supporting holes each serving for supporting a core to be used for molding the water jacket, at the central portion of the cylinder head, that is, between the cylinder #2 and the cylinder #3. As well known in the art, the core supporting holes are also used as vent holes for releasing gas from an inside of the water jacket during the casting. Generally, the core supporting holes are formed in a plurality of portions on an upper surface of the cylinder head. In general, when viewed in a cross section of the cylinder head, an upper surface (a ceiling surface) of the water jacket is lifted up, i.e., formed into a curved shape to have a largest height, in the vicinity of a central part thereof. For this reason, it is possible to most efficiently release gas by providing the core supporting holes at the central portion of the cylinder head. That is, if one of the core supporting holes can be provided at the central portion of the cylinder head, the number of the core supporting holes as the vent holes can be minimized, and occurrence of defects due to residual gases can be more certainly avoided.

In the above-described construction of the conventional art, since the core supporting holes cannot be provided at the central portion of the cylinder head, it is undesirably required to provide an increased number of the core supporting holes for the purpose of releasing gas.

Further, in the above-described construction of the conventional art, the pin mounted as a separate part on the cylinder head must be used as the fulcrum portion of the clamp. This results in a problematic increase in number of the parts.

Means for Solving Problems

In one aspect of the present invention, there is provided a cylinder head for a multi-cylinder internal combustion engine which includes a water jacket formed therein by using a core during casting, and a plurality of fuel injection valves which are each inserted into an injection valve mounting hole extending through a generally central portion of a combustion chamber in respective multiple cylinders, the fuel injection valves being fixed to the cylinder head through a plurality of bifurcated clamps. Each of the clamps includes a base portion brought into abut contact with and supported on a stationary fulcrum portion on the side of the cylinder head, a bifurcated tip end portion pressing the fuel injection valve, and an intermediate portion fastened by a bolt having a tip end portion which is screwed into the cylinder head.

The plurality of clamps are arranged in an attitude aligned on a straight line along a direction of a row of the cylinders and disposed so as to correspond to two cylinder groups into which the multiple cylinders are divided, that is, a front cylinder group and a rear cylinder group. The clamps corresponding to the front cylinder group are arranged such that the base portions are located on a front side of the engine and the bifurcated end portions are located on a rear side of the engine. The clamps corresponding to the rear cylinder group are arranged such that the base portions are located on the rear side of the engine and the tip end portions are located on the front side of the engine. That is, the clamps corresponding to the front cylinder group and the clamps corresponding to the rear cylinder group are arranged in an attitude oriented to opposite directions such that the tip end portions of the respective clamps are oriented inwardly and the stationary fulcrum portions of the respective clamps are oriented outwardly. With this arrangement, it is possible to ensure a space between the two cylinder groups so that a core supporting hole can be disposed between the two clamps in an upper surface of the cylinder head.

In one preferred embodiment of the present invention, an intake camshaft and an exhaust camshaft are disposed on both sides of the respective fuel injection valves, and fastening bolts for cam brackets are fastened to the cylinder head so as to support at least one of the intake camshaft and the exhaust camshaft between the cylinder head and the cam brackets. A head of each of the fastening bolts is used as the stationary fulcrum portion.

Effect of Invention

According to the above construction, a core supporting hole serving as a vent hole during the casting can be disposed at a central portion of the cylinder head without being interfered with the stationary fulcrum portions of the clamps. As a result, it is possible to effectively release gas from the inside of the water jacket during casting. Therefore, an increased number of core supporting holes or vent holes are not necessitated to thereby more certainly avoid occurrence of defects due to residual gases during the casing.

DESCRIPTION OF EMBODIMENTS

In the following, an embodiment of the present invention is explained by referring to the accompanying drawings.

Figure 1:
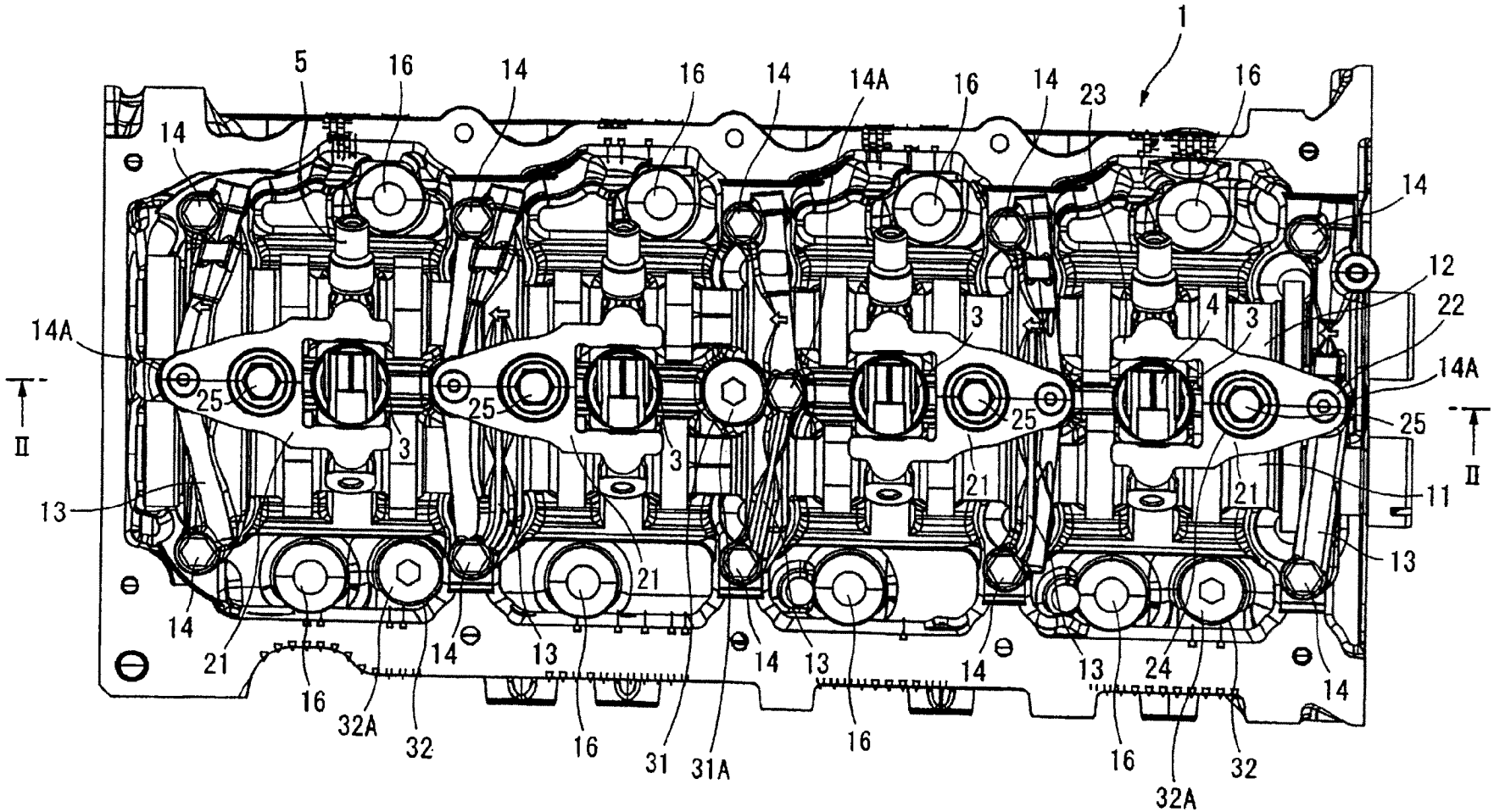
FIG. 1 is a plan view of a cylinder head according to an embodiment of the present invention.
Figure 2:
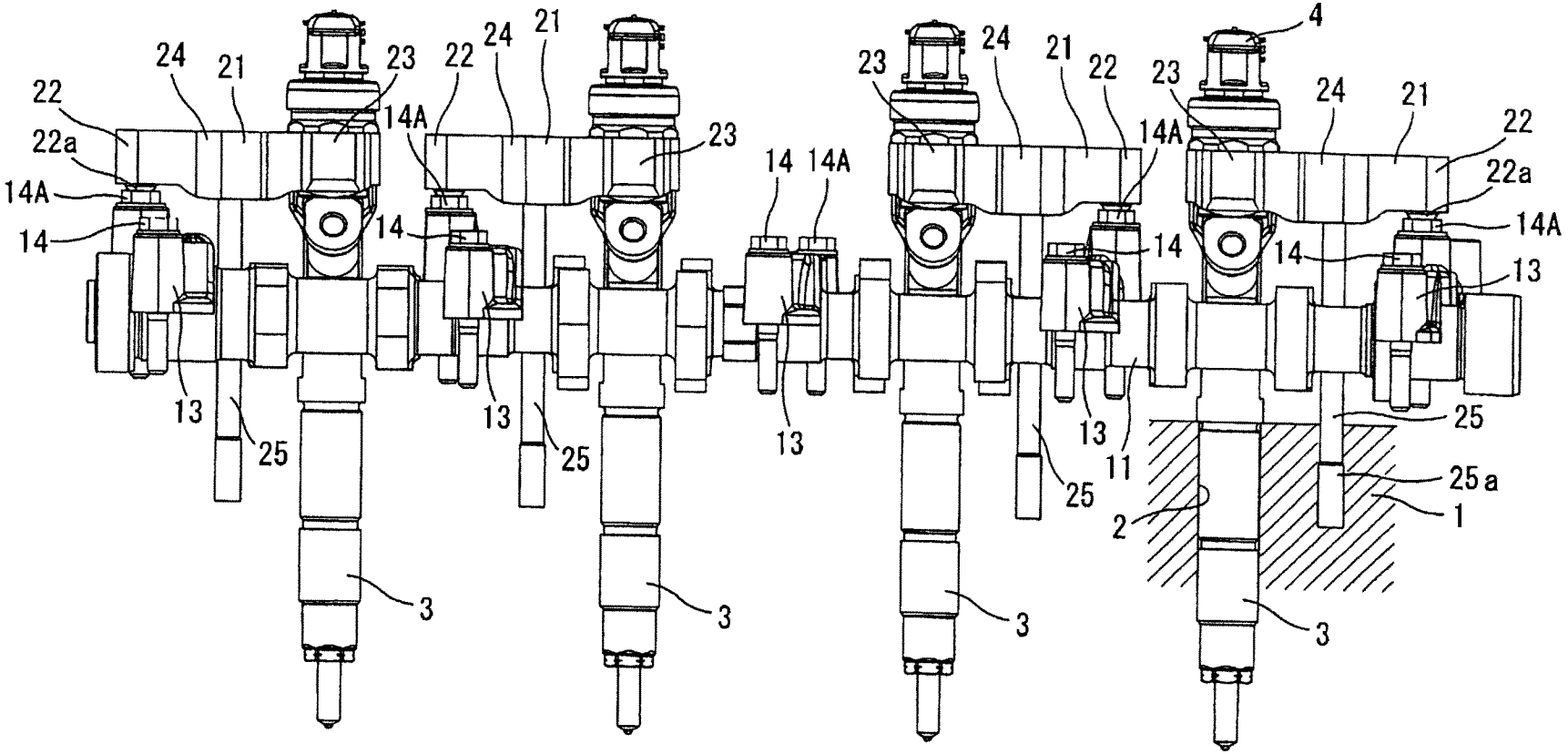
FIG. 2 is a sectional view of an essential portion of the cylinder head, taken along line II-II.

FIG. 1 and FIG. 2 show a cylinder head according to the embodiment of the present invention which is applied to an in-line four-cylinder diesel engine. FIG. 1 shows cylinder head 1 simply before being mounted to a cylinder block, from which a cylinder head cover (not shown) is dismounted. Cylinder head 1 is formed by casting using a material such as aluminum alloy or cast iron, as well known in the art. Cylinder head 1 is formed into a generally rectangular prism-shape, and has a water jacket (not shown) inside thereof which serves as a cooling water passage. The water jacket having a complicated shape is formed by casting using a core. Each of cylinders has injection valve mounting hole 2 (see FIG. 2) at an approximately central part of a combustion chamber thereof. Injection valve mounting hole 2 extends through the central part of the combustion chamber in the vertical direction (that is, in the direction parallel with an axis of the cylinder), into which fuel injection valve 3 is inserted. Fuel injection valve 3 is formed into a thin rod shape and constructed as a so-called common-rail fuel injection device so as to be electrically opened and closed. Fuel injection valve 3 is provided at a top portion thereof with connecter 4 (see FIG. 2) for an electric harness, and fitted with fuel connecter portion 5 to which a fuel pipe is connected. Fuel connecter portion 5 diagonally upwardly extends from a middle portion of fuel injection valves 3.

Further, intake camshaft 11 and exhaust camshaft 12 are disposed on both sides of four fuel injection valves 3 arranged in a row. Intake camshaft 11 and exhaust camshaft 12 actuate intake valves and exhaust valves (either not shown) to move between an opened position and a closed position, respectively. A pair of the intake valve and the exhaust valve are provided for each cylinder. Intake camshaft 11 and exhaust camshaft 12 are rotatably supported between a semi-circular bearing surface formed on the side of cylinder head 1 and a semi-circular bearing surface formed on each of cam brackets 13 which are fastened to cylinder head 1 by means of bolts. Each of cam brackets 13 is formed as an integral part to extend across both intake camshaft 11 and exhaust camshaft 12. Each of cam brackets 13 is fastened to cylinder head 1 at three points, that is, at both end portions of cam bracket 13 and a middle portion of cam bracket 13 between the end potions thereof, by means of bolts 14. Middle bolt 14 located at the middle portion of cam bracket 13 (as indicated by reference numeral 14A) is positioned slightly offset from a pair of bolts 14 located at the both end portions of cam bracket 13 in a direction of the row of the cylinders. Specifically, the middle bolt 14A located on front-side cam brackets 13 of #1 and #2 among five cam brackets 13 of #1 to #5 is slightly offset toward the front side of the engine, and the middle bolt 14A located on rear-side cam brackets 13 of #3 to #5 is slightly offset toward the rear side of the engine. Incidentally, a left side of FIG. 1 corresponds to the front side of the engine and a right side of FIG. 1 corresponds to the rear side of the engine. In addition, cylinder head 1 is provided on both sides thereof, that is, outside of intake camshaft 11 and exhaust camshaft 12 with a plurality of cylinder head bolt holes 16 to which cylinder head bolts for mounting cylinder head 1 to the cylinder block, not shown, are inserted.

Fuel injection valves 3 inserted into the above-described injection valve mounting holes 2 are fixed to cylinder head 1 through bifurcated clamps 21, respectively. Each of clamps 21 includes tapered base portion 22 which is brought into abut contact with and supported on a stationary fulcrum portion on the side of cylinder head 1, bifurcated tip end portion 23 which is engaged with a step portion of fuel injection valves 3 and presses fuel injection valves 3 in the axial direction of the cylinder, and intermediate portion 24 fastened by bolt 25 (see FIG. 2) having tip end portion 25*a* which is screwed into cylinder head 1. Each of clamps 21 serves as a kind of a lever which is swingable upward and downward about base portion 22 as a fulcrum, and stiffly and fixedly holds fuel injection valve 3. As shown in FIG. 2, bolt 14A located at the middle portion of cam bracket 13 is used as a stationary fulcrum portion to come into abut contact with base portion 22. More specifically, a top surface of a head of the middle bolt 14A is contacted with projection 22*a* formed on a lower surface of base portion 22. The head of the middle bolt 14A is offset above from the pair of bolts 14 located at the both end portions of cam bracket 13 such that clamp 21 is held at a substantially horizontal attitude (perpendicular to the axis of the cylinder).

Four clamps 21 respectively fixing fuel injection valves 3 are arranged between intake camshaft 11 and exhaust camshaft 12 in alignment with each other on a straight line along the direction of the row of the cylinders. Clamps 21 corresponding to cylinders #1 and #2 are arranged at such an attitude that base portions 22 are disposed on the front side of the engine and tip end portions 23 are disposed on the rear side of the engine. In contrast, clamps 21 corresponding to cylinders #3 and #4 are arranged at such an attitude that base portions 22 are disposed on the rear side of the engine and tip end portions 23 are disposed on the front side of the engine, symmetrically to clamps 21 corresponding to cylinders #1 and #2. In other words, four cam brackets 13 of #1, #2, #4 and #5 among five cam brackets 13 of #1 to #5 are respectively used as the stationary fulcrum portion of clamp 21. In addition, four clamps 21 are symmetrically arranged such that the bifurcated tip end portions of respective clamps 21 are directed to the center of cylinder head 1, that is, to a position between cylinder #2 and cylinder #3. Cam bracket 13 of #3 located at a central portion of cylinder head 1 in a longitudinal direction of cylinder head 1 does not serve to support clamp 21. As shown in FIG. 2, the middle bolt 14A on the #3 cam bracket 13 is positioned at the same height as the pair of bolts 14 at the both end portions of the #3 cam bracket 13.

With the above-described arrangement of clamps 21, the central portion of cylinder head 1 which is free from coverage by clamp 21 is allowed to provide core supporting hole 31 which acts to support a core to be used for forming the water jacket. Core supporting hole 31 is disposed adjacent to the #3 cam bracket 13, and more particularly, disposed on the front side of the engine offset from the middle bolt 14A at the #3 cam bracket 13 which is located offset toward the rear side of the engine. Further, cylinder head 1 has a pair of core supporting holes 32 which are disposed at two portions of cylinder head 1, that is, at a front end portion of cylinder head 1 and a rear end portion of cylinder head 1, which are offset from the central portion of cylinder head 1 toward the side of the intake valve. Core supporting holes 32 are disposed adjacent to cylinder head bolt holes 16 which are located on the side of cylinder #1 and on the side of cylinder #4, respectively. These core supporting holes 31, 32 are formed by a stick-shaped portion which forms a part of the core and supports the core during casting, and serve as vent holes through which gas is released during casing. In this embodiment, since the pair of core supporting holes 32 are disposed on the intake valve side and no core supporting hole as a vent hole is provided on the exhaust valve side, casting is carried out with holding a mold at a slightly inclined attitude such that the intake valve side is located higher than the exhaust valve side. After the casting, core supporting holes 31, 32 are sealed by pressure-fitting plugs 31A, 32A thereinto.

In cylinder head 1 according to the above-described embodiment, core supporting hole 31 can be arranged at the central portion of cylinder head 1 without interfering with the stationary fulcrum portion of clamp 21. With this arrangement, it is possible to effectively release gas from an inside of the water jacket during casting. Accordingly, ventilation can be surely performed by the minimum number (i.e., three) of the core supporting holes, that is, core supporting hole 31 and core supporting holes 32 provided on both the front end portion of cylinder head 1 and the rear end portion thereof. As a result, it is possible to not only avoid deterioration in strength due to provision of a large number of core supporting holes but also more certainly suppress occurrence of defects due to residual gases during casting.

Further, since bolt 14A located at the middle portion of cam bracket 13 is disposed in a higher position and used as the stationary fulcrum portion of clamp 21, the number of parts constituting cylinder head 1 can be reduced. Furthermore, the middle bolt 14A to be used as the stationary fulcrum portion of clamp 21 is positioned offset from the pair of bolts 14 at both end portions of clamp 21 in the direction of the row of the cylinders. With this arrangement, supporting rigidity of cam bracket 13 can be increased to thereby certainly bear a load input from base portion 22 of clamp 21.

Although in the above-described embodiment, a cylinder head for an in-line four-cylinder internal combustion engine is explained, the present invention is not limited to this embodiment and can be applied to a cylinder head for an internal combustion engine having an optional number of cylinders, for instance, in-line three cylinders, in-line five cylinders, in-line six cylinders and the like, or a cylinder head on one of opposed banks of an internal combustion engine such as a V-type six-cylinder internal combustion engine and a V-type eight-cylinder internal combustion engine.

REFERENCE NUMERALS

1 . . . cylinder head
2 . . . injection valve mounting hole
3 . . . fuel injection valve
11 . . . intake camshaft
12 . . . exhaust camshaft
13 . . . cam bracket
14 . . . bolt
21 . . . clamp
22 . . . base portion
23 . . . tip end portion
24 . . . intermediate portion
25 . . . bolt
31, 32 . . . core supporting hole

The invention claimed is:

1. A cylinder head for a multi-cylinder internal combustion engine, the cylinder head having a water jacket formed in the cylinder head by using a core during casting, the cylinder head comprising: fuel injection valves each inserted into an injection valve mounting hole extending through a generally central part of a combustion chamber in each of multiple cylinders, wherein the fuel injection valves inserted into the injection valve mounting holes are fixed to the cylinder head through a plurality of bifurcated clamps, the clamps each including a base portion brought into abut contact with and supported on a stationary fulcrum portion on a side of the cylinder head, a bifurcated tip end portion pressing the fuel injection valve, and an intermediate portion fastened by a bolt having a tip end portion which is screwed into the cylinder head, wherein the clamps are arranged at an attitude aligned on a straight line along a direction of a row of the multiple cylinders, wherein the multiple cylinders are divided into two cylinder groups which include a front cylinder group and a rear cylinder group, the clamps being arranged so as to correspond to the front cylinder group and the rear cylinder group, the clamps corresponding to the front cylinder group being arranged such that the base portions are located on a front side of the engine and the bifurcated tip end portions are located on a rear side of the engine, the clamps corresponding to the rear cylinder group being arranged such that the base portions are located on the rear side of the engine and the tip end portions are located on the front side of the engine, and wherein a core supporting hole is provided in an upper surface of the cylinder head between the two cylinder groups, the core supporting hole being disposed between two of the clamps.

2. The cylinder head as claimed in claim 1, further comprising: an intake camshaft and an exhaust camshaft which are disposed on both sides of the fuel injection valves; and cam brackets each fastened by cam bracket fastening bolts to the cylinder head so as to support at least one of the intake camshaft and the exhaust camshaft between the cylinder head and the cam brackets, wherein one of the cam bracket fastening bolts for each of the cam brackets has a head which is used as the stationary fulcrum portion.

3. The cylinder head as claimed in claim 2, wherein each of the cam brackets is formed as an integral part to extend across both the intake camshaft and the exhaust camshaft, wherein each of the cam brackets is fastened to the cylinder head at three points which include both end portions of the cam bracket and a middle portion of the cam bracket between the both end potions, by the cam bracket fastening bolts, and wherein the cam bracket fastening bolts include a middle fastening bolt which is located at the middle portion of the cam bracket and used as the stationary fulcrum portion, and a pair of end fastening bolts located at the both end portions of the cam bracket, the middle fastening bolt being positioned slightly offset from the pair of end fastening bolts in the direction of the row of the multiple cylinders.

4. The cylinder head as claimed in claim 1, wherein the cylinder head is applied to an in-line four-cylinder internal combustion engine, and wherein the core supporting hole is disposed at a central portion of the cylinder head in the direction of the row of the multiple cylinders, and a pair of core supporting holes are disposed at a front end portion of the cylinder head and a rear end portion of the cylinder head and offset toward either an intake valve side or an exhaust valve side.

5. The cylinder head as claimed in claim 4, wherein the respective core supporting holes are used as a vent hole through which gas is released from the water jacket during casting.

6. The cylinder head as claimed in claim 3, wherein the cam brackets comprise the cam bracket which is located at a central portion of the cylinder head in a longitudinal direction of the cylinder head and does not serve to support the clamp.

7. The cylinder head as claimed in claim 6, wherein the core supporting hole is located adjacent to the middle fastening bolt on the cam bracket which is located at a central portion of the cylinder head in a longitudinal direction of the cylinder head.

8. The cylinder head as claimed in claim 6, wherein the middle fastening bolt disposed at the middle portion of the cam bracket which is located at a central portion of the cylinder head in a longitudinal direction of the cylinder head is positioned at the same height as the pair of end fastening bolts disposed at the both end portions of the cam bracket which is located at a central portion of the cylinder head in a longitudinal direction of the cylinder head.

* * * * *